United States Patent [19]

Turner et al.

[11] 4,012,156

[45] Mar. 15, 1977

[54] RETRACTABLE SAFETY SPEED BUMP

[76] Inventors: William Turner, Box 1012, Walterboro, S.C. 29488; John Heath Turner, 2305 Huntingdon Road, Huntingdon Valley, Pa. 19006

[22] Filed: Mar. 4, 1976

[21] Appl. No.: 664,040

[52] U.S. Cl. ..... 404/15; 49/93

[51] Int. Cl.[2] ..... E01F 11/00

[58] Field of Search ..... 404/15, 16, 14, 11, 404/9, 6; 49/93

[56] References Cited

UNITED STATES PATENTS

| | | | |
|---|---|---|---|
| 1,543,539 | 6/1925 | Wrightson | 404/6 X |
| 3,023,986 | 3/1962 | Nallinger | 401/1 X |
| 3,325,782 | 6/1967 | Der | 404/1 X |

FOREIGN PATENTS OR APPLICATIONS

| | | | |
|---|---|---|---|
| 812,597 | 5/1937 | France | 404/6 |

*Primary Examiner*—Nile C. Byers, Jr.
*Attorney, Agent, or Firm*—B. P. Fishburne, Jr.

[57] ABSTRACT

A permanently installed speed bump or warning device for motorists is particulary adaptable for usage at school crossings and the like. The structure has an active use position above the road surface for deterring and warning drivers and is easily retractable to a nested position wherein a flat surface flush with the roadway is provided so as to allow the smooth passage of vehicles over the device. A convenience tool is provided for moving the device from its active to its inactive positions, and vice-versa.

8 Claims, 5 Drawing Figures

RETRACTABLE SAFETY SPEED BUMP

BACKGROUND OF THE INVENTION

The use of speed bumps in school parking lots, driveways and near certain controlled crossings is well known. These bumps or warning devices for motorists are permanent structures usually formed of paving material and are not easily removed once installed. They can be very inconvenient in situations where there is only a periodic need for slow traffic, as at school crossings at the beginning and ending of the school day.

The need has been recognized for a removable device of this character as evidenced by prior U.S. Pat. No. 3,720,181, which discloses an inflatable flexible speed bump which can be placed across a roadway to warn drivers during selected periods as when school children are leaving school or entering in the morning. While the patented inflatable device is practical, it has the disadvantage of requiring installation and/or inflation at the time of each usage, and inherently, due to the inflatable and flexible nature of the device, it lacks the durability necessary for long life on a roadway having heavy traffic flow.

With the above in mind, the present invention has for its objective to provide a permanently installed retractable rigid speed bump of sturdy and durable construction which will withstand vehicular traffic indefinitely and which does not require periodic removal from the roadway site and replacement on a daily or more frequent basis. Instead, in the case of the invention, it is only necessary for a school crossing guard, or other personnel, to employ a simple manual tool and shift the speed bump from a nested non-active position wherein traffic may flow smoothly across the device to an above ground active use position where drivers will be alerted to the presence of school children at the adjacent school crossing. The invention is much more convenient than anything in the comparable prior art, is more economical over a long period of time and is much more sturdy and durable. It completely overcomes all of the principal deficiencies of the prior art.

Other features and advantages of the invention will become apparent during the course of the following description.

BRIEF DESCRIPTION OF DRAWING FIGURES

DETAILED DESCRIPTION

Figure 1:
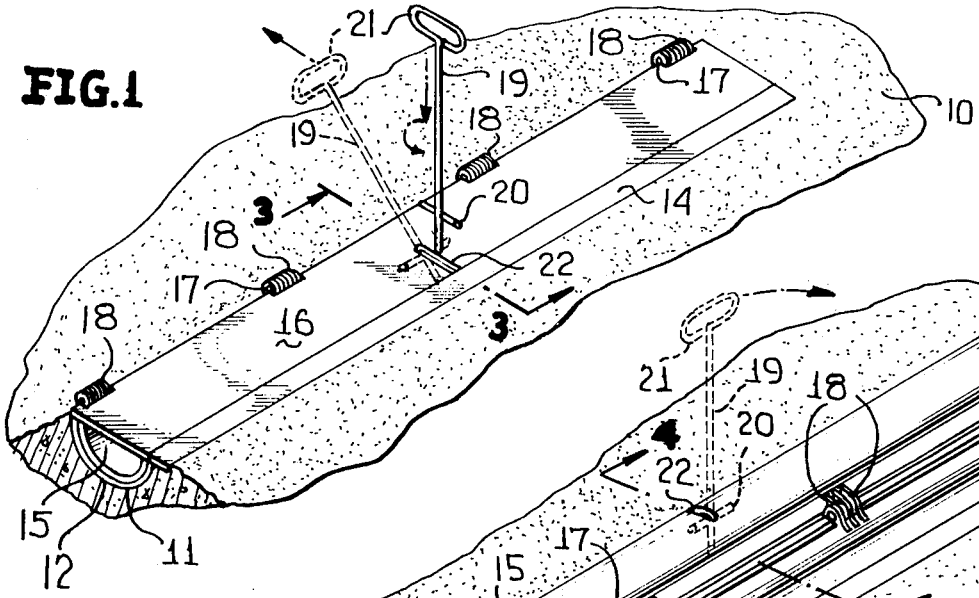
FIG. 1 is a perspective view of the invention showing the speed bump in the retracted position flush with the surface of the roadway and showing a separate manipulating tool or implement.

Referring to the drawings in detail wherein like numerals designate like parts, the numeral 10 designates a paved roadway adjacent a school crossing zone or the like. At this point, the pavement 10 is formed with a semi-cylindrical recess 11 which receives the invention permanently. The invention comprises a preferably semi-cylindrical relatively fixed base section 12 adapted to be formed from suitable piping and of a size and shape to interfit with the recess 11 and be seated therein. The base section 12 may have anchoring elements 13 welded thereto and such elements may be embedded in the pavement to insure that the section 12 will be fixed or immovable.

Preferably the base section 12 has a forward longitudinal flat lip 14 or plate welded thereto and being recessed so as to lie flush with the pavement or roadway surface. The relatively stationary base section 12 of the speed bump is concave and upwardly open, as shown, throughout its length.

Figure 2:
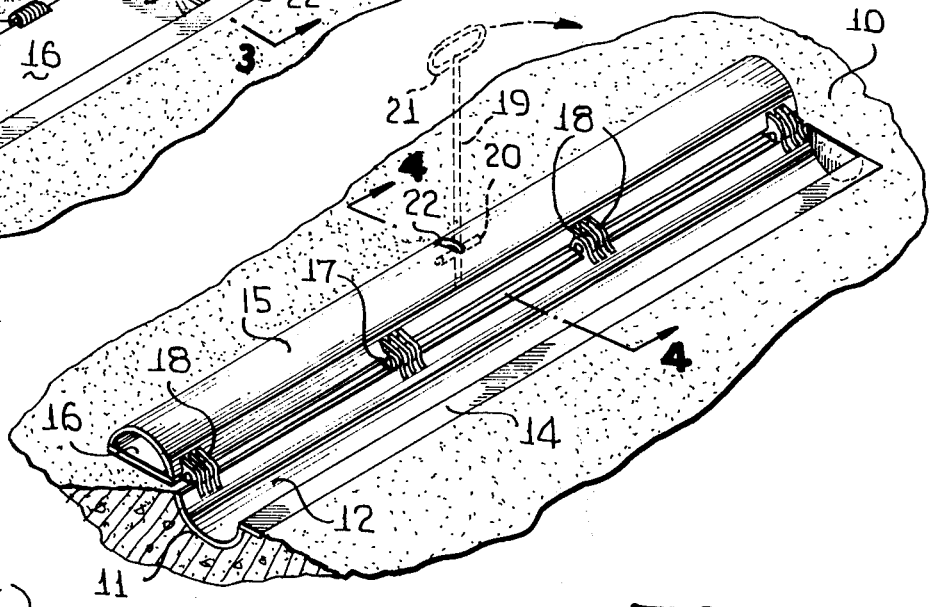
FIG. 2 is a similar view showing the speed bump in the active use position above the roadway surface.
Figure 3:
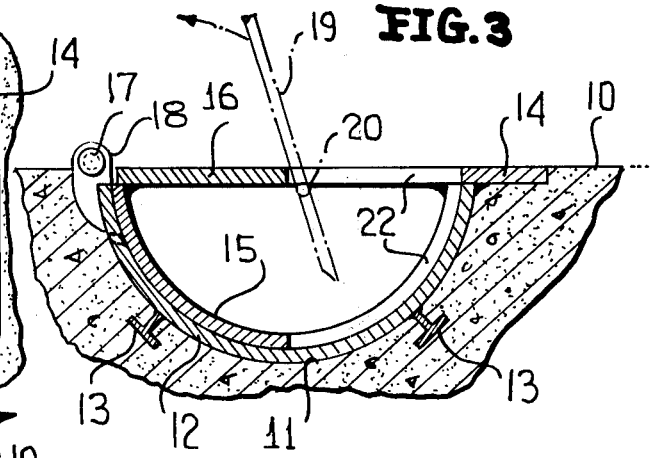
FIG. 3 is an enlarged transverse vertical section taken on line 3—3 of FIG. 1.
Figure 5:
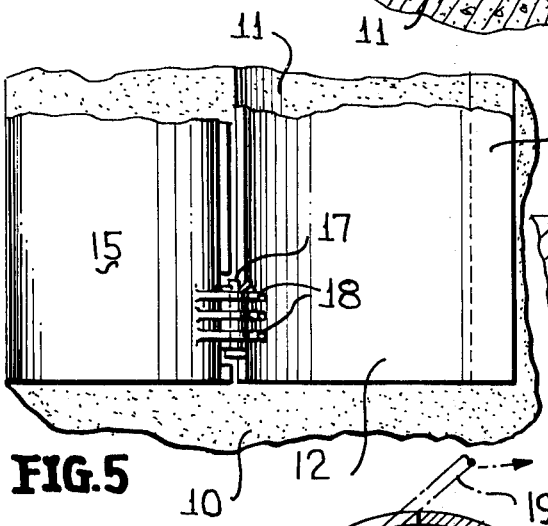
FIG. 5 is a fragmentary plan view of the device as illustrated in FIG. 2.

The device comprises a complementally-shaped semi-cylindrical hinged or movable section 15 which nests or interfits within the concave base section 12 when the device is in a non-active position, FIG. 1, to allow the unimpeded flow of traffic thereover. To facilitate this, the pivoted section 15 has a flat plate 16 welded across its open side diametrically to form a support for vehicle wheels, and this flat plate is flush with the lip 14 and roadway surface when the speed bump is in the inactive position shown in FIGS. 1 and 3. The connected elements 15 and 16 form a semi-cylindrical tubular or hollow member, as clearly shown in FIG. 2.

The two sections 12 and 15 of the device are hingedly connected along the rear edge remote from the lip 14 by preferably hardened steel hinge pins 17 received through interfitting apertured knuckles 18 formed on or welded to the respective parts 12 and 15. The construction permits the movable section 15 of the speed bump to be swung radially between the use position of FIG. 2 and the nested flush or retracted position of FIG. 1.

Figure 4:
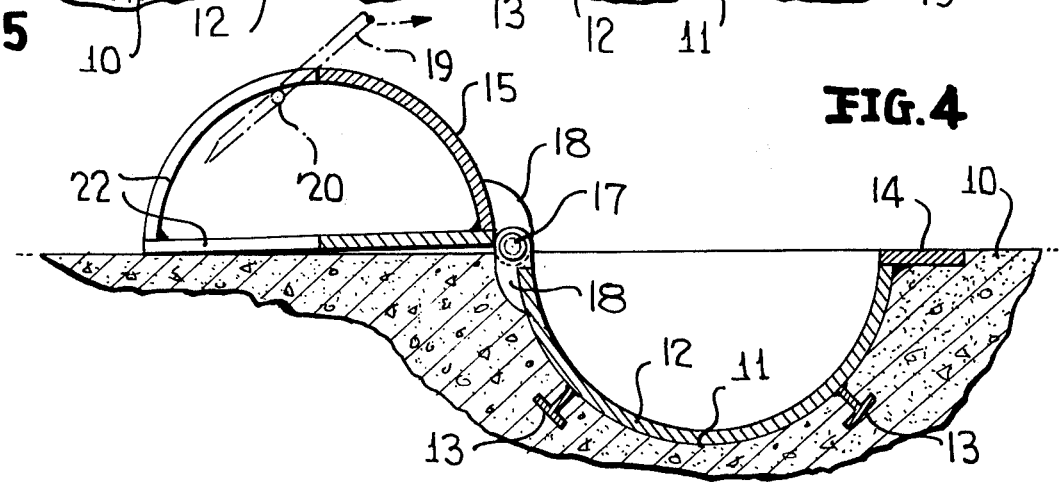
FIG. 4 is a similar view taken on line 4—4 of FIG. 2.

To facilitate this movement, a hand manipulating tool 19 or rod is provided having a cross pin 20 near and above its lower end and a convenience handle 21. To accommodate the tool 19, a transverse slot 22 is formed through one side of the flat plate 16 and continues through the adjacent quarter sector of the semi-cylindrical member 15. This slot may receive the rod 19 and cross pin 20 with the latter turned parallel to the slot, FIG. 1, and then by turning the tool until the pin 20 extends across the slot 22, the movable section 15 may be raised, FIG. 3, or returned to its nested position by the tool, FIG. 4, as designated by the direction arrows. After use, the tool is easily separated from the speed bump structure and can be kept at any convenient place.

The device is characterized by simplicity, convenience of operation, strength and durability, and economy, when measured over the long term compared to prior art devices which must frequently be replaced. The advantages of the invention should now be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A retractable speed bump comprising a concave section adapted for mounting fixedly within a roadway recess and being upwardly open, and a complementally shaped movable section nestably engagable within said concave section and when in such position having a top plate portion substantially flush with the roadway surface within which the concave section is mounted, said movable section shiftable to an active speed bump forming position wherein the movable section is inverted and has said top plate portion disposed lowermost and resting on the roadway surface at one side of said roadway recess and said concave section.

2. A retractable speed bump as defined by claim 1, and said concave and movable sections being hingedly joined along one longitudinal edge portion of each.

3. A retractable speed bump as defined by claim 2, and said concave and movable sections being approximately semi-cylindrical in cross section and said top plate portion being a flat plate spanning the movable section diametrically, both said sections being elongated and being of sufficient length to substantially span a vehicular traffic lane on a roadway.

4. A retractable speed bump as defined by claim 3, and spaced anchoring elements fixed on the exterior of said concave section for embedment in the paving material of said roadway.

5. A retractable speed bump as defined by claim 4, and a longitudinal lift plate secured to one side edge of said concave section and lying in the same plane with said top plate portion when said concave and movable sections are nested.

6. A retractable speed bump as defined by claim 1, and a manually operated implement detachably engagable with said movable section to shift it to and from said nested and active positions.

7. A retractable speed bump as defined by claim 2, and a manually operated implement detachably engageable with said movable section to shift it to and from said nested and active positions.

8. A retractable speed bump as defined by claim 7, and said movable section having a slot adapted to receive said implement in separable interlocking engagement.

* * * * *